US007501766B2

(12) United States Patent
Selverian et al.

(10) Patent No.: US 7,501,766 B2
(45) Date of Patent: Mar. 10, 2009

(54) LAMP HAVING AN ENVELOPE WITH AN OXIDATION RESISTANT SEAL EMPLOYING A UNIDIRECTIONAL CARBON FIBER MAT INFILTRATED WITH SIC

(75) Inventors: John H. Selverian, North Reading, MA (US); Ernest Davey, Salem, NH (US)

(73) Assignee: Osram Sylvania Inc., Danvers, MA (US)

( * ) Notice: Subject to any disclaimer, the term of this patent is extended or adjusted under 35 U.S.C. 154(b) by 0 days.

(21) Appl. No.: 11/532,934

(22) Filed: Sep. 19, 2006

(65) Prior Publication Data

US 2008/0067939 A1 Mar. 20, 2008

(51) Int. Cl.
*H01J 17/04* (2006.01)

(52) U.S. Cl. ..... 313/633; 313/623

(58) Field of Classification Search ..... None
See application file for complete search history.

(56) References Cited

U.S. PATENT DOCUMENTS

| | | | | |
|---|---|---|---|---|
| 4,534,997 | A * | 8/1985 | Brotz | 427/538 |
| 4,540,373 | A | 9/1985 | Rothwell et al. | |
| 5,021,711 | A * | 6/1991 | Madden et al. | 313/623 |
| 5,142,195 | A | 8/1992 | Heider et al. | |
| 6,787,189 | B2 * | 9/2004 | Konno et al. | 427/377 |
| 2005/0253521 | A1 * | 11/2005 | Scholl et al. | 313/626 |

OTHER PUBLICATIONS

SiC-C fiber electrode for biological sensing, Songh et al., Jul. 7, 2006, Materials Science and Engineering, p. 551-557.*

Qing Zhang, Laifei Cheng, Litong Zhang, Yongdong Xu, Thermal expansion behavior of carbon fiber reinforced chemical-vapor-infiltrated silicon carbide composites from room temperature to 1400 [degree sign]C, Materials Lettersvol. 60, Issue 27, , Nov. 2006, pp. 3245-3247. (http://www.sciencedirect.com/science/article/B6TX9-4JHMGWS-6/1/e5b07a3.*

Laifei Cheng, Yongdong Xu, Litong Zhang, Xingang Luan, Oxidation and defect control of CVD SiC coating on three-dimensional C/SiC composites, Carbonvol. 40, Issue 12, , 2002, pp. 2229-2234. (http://www.sciencedirect.com/science/article/B6TWD-45D8H32-2/1/b65f4589ec7f4306633eec66f0befef0) Keywords: A. Carbon composites; B. Coating, Oxidation.*

* cited by examiner

*Primary Examiner*—Toan Ton
*Assistant Examiner*—Britt Hanley
(74) *Attorney, Agent, or Firm*—Robert F. Clark

(57) ABSTRACT

There is described a lamp having a high-temperature glass envelope, at least one feedthrough assembly, and a light source disposed within the envelope; the at least one feedthrough assembly having an inner electrical lead connected to the light source, an outer electrical lead for conducting electrical energy from an outside source to the light source, and an intermediate connector electrically connecting the inner and outer electrical leads, the intermediate connector being resistant to oxidation within a temperature range up to 1200° C. and having a thermal expansion coefficient in the range of 0-2 ppm/° C.; and the intermediate connector being sealed within a seal area of the envelope.

7 Claims, 1 Drawing Sheet

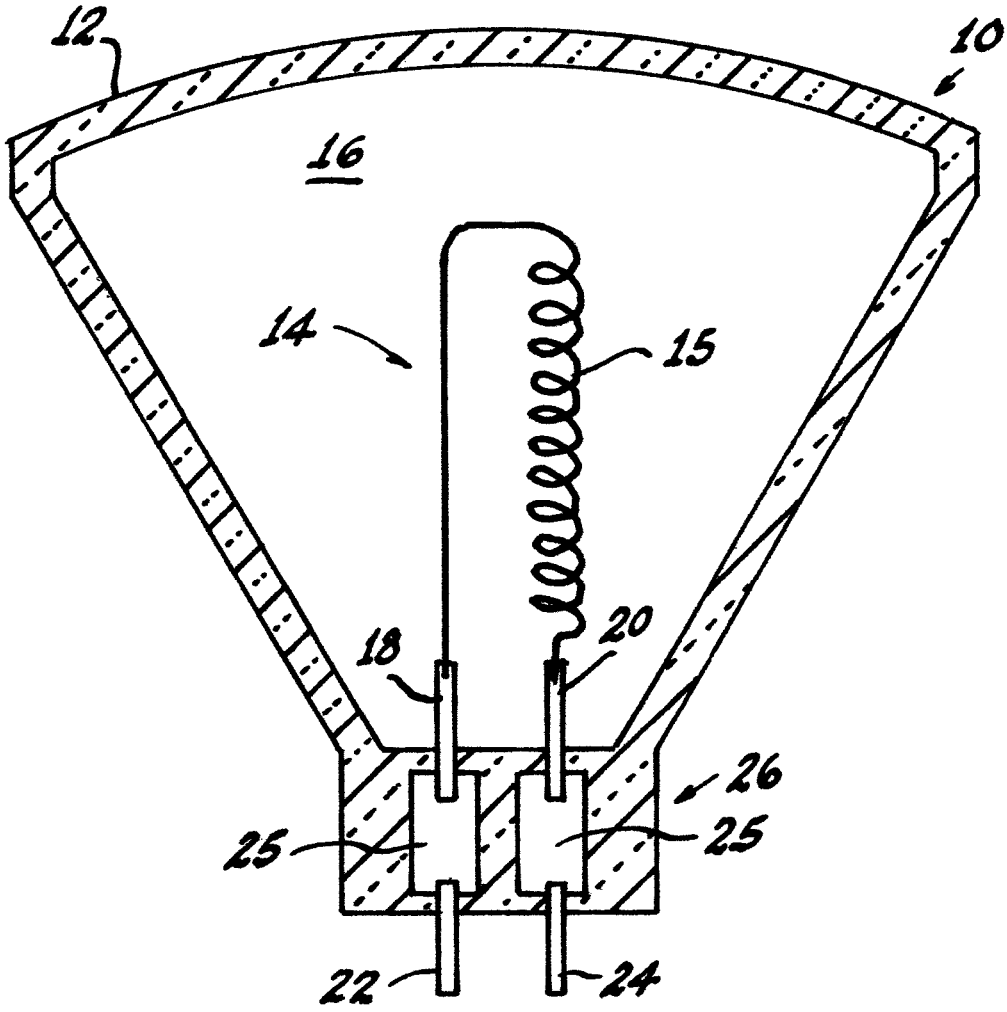
12
10
16
14
15
18
20
26
25
25
22
24

LAMP HAVING AN ENVELOPE WITH AN OXIDATION RESISTANT SEAL EMPLOYING A UNIDIRECTIONAL CARBON FIBER MAT INFILTRATED WITH SIC

TECHNICAL FIELD

This invention relates to glass sealing and more particularly to oxidation-resistant seals. Still more particularly it relates to seals for electric lamps.

BACKGROUND ART

A number of electric lamp types, particularly tungsten-halogen, metal halide and high-pressure mercury, employ a feedthrough comprised of a molybdenum foil which is sealed into a fused quartz, fused silica, or other high-silica-content glass envelope in order to provide an electrical connection between the inner and outer electric leads. The molybdenum foil has a better thermal expansion match to the high-temperature, low-expansion glass than the electric leads which are usually tungsten. The foil is sealed within the glass by pressing or pinching the hot, softened glass to encase the foil and form a hermetic seal. This technique is well-known in the art, various examples of which may be found in U.S. Pat. Nos. 5,021,711, 5,142,195 and 4,540,373, which are incorporated herein by reference.

One particular condition that adversely effects the seal is oxidation of the molybdenum foil during operation of the lamp. The oxidation causes a degradation of the electrical conductivity of the foil, which reduces the performance of the lamp and, ultimately, causes a failure of the lamp. If the oxidation becomes extreme it can cause failure of the seal itself, which also leads to the lamp failure.

SUMMARY OF THE INVENTION

It is, therefore, an object of the present invention to obviate the disadvantages of the prior art.

It is another object of the invention to enhance lamp operation.

Still another object of the invention is the enhancement of hermetic seals in lamps having envelopes made of a high-temperature glass.

These objects are accomplished, in one aspect of the invention, by a lamp having a high-temperature glass envelope, at least one feedthrough assembly, and a light source disposed within the envelope; the at least one feedthrough assembly having an inner electrical lead connected to the light source, an outer electrical lead for conducting electrical energy from an outside source to the light source, and an intermediate connector electrically connecting the inner and outer electrical leads, the intermediate connector being resistant to oxidation within a temperature range up to 1200° C. and having a thermal expansion coefficient in the range of 0-2 ppm/° C.; and the intermediate connector being sealed within a seal area of the envelope.

BRIEF DESCRIPTION OF THE DRAWING

The single FIGURE is a diagrammatic, sectional view of a lamp employing an aspect of the invention.

DETAILED DESCRIPTION OF THE INVENTION

For a better understanding of the present invention, together with other and further objects, advantages and capabilities thereof, reference is made to the following disclosure and appended claims taken in conjunction with the above-described drawing.

Referring now to the FIGURE with greater particularity, there is shown a lamp 10 having an hermetically sealed envelope 12 made of a high-temperature glass, preferably fused quartz, fused silica or a high-silica content glass (>95% by weight $SiO_2$) such as Vycor®. As shown in this particular embodiment, the light source 14 is a tungsten filament 15 situated within the volume 16 of the glass envelope 12. However, the choice of the light source is not limited. For example, the light source may comprise an arc discharge such as is present in metal halide and high-pressure mercury lamps. In such cases, the inner electrical leads may comprise tungsten electrodes which serve as the attachment points for the arc discharge. Depending on the type of lamp, the volume 16 may contain a fill gas, such as a halogen-containing gas as in a tungsten-halogen lamp, small amounts of various metal halide salts, or mercury. Moreover, the light source 14 may be further contained within an inner envelope such as a ceramic or quartz arc tube or the lamp envelope 14 may be enclosed in an outer jacket. Thus, the term "envelope" as used herein is not restricted to comprising the outermost enclosure of a lamp and may instead comprise an inner containment vessel such as an arc tube.

Referring again to the FIGURE, a pair of inner electrical leads, 18, 20, are attached to the light source 14, and a pair of outer electrical leads, 22. 24, are provided for conducting electrical energy from an outside source (not shown) to the light source 14. An intermediate connector 25 electrically joins the inner and outer pairs of electrical leads and is sealed in a seal area 26 of the envelope 12. The combination of an inner electrical lead, an intermediate connector and an outer electrical lead together comprising a feedthrough assembly.

The intermediate connector 25 is resistant to oxidation up 1200° C. and has a thermal expansion coefficient in the range of 0-2 ppm/° C. A preferred material is a carbon/silicon carbide (C/SiC) composite. Materials of this type are available from Hyper-Therm of Huntington Beach, Calif.

Preferably, the composite material comprises a uni-directional carbon fiber mat having silicon carbide infiltrated therein. This material is electrically conductive and extremely resistant to oxidation even at temperatures well in excess of 1200° C. The electrical leads can be brazed or soldered to the intermediate connector and, because its thermal expansion coefficient matches that of the high-temperature glass even better than molybdenum, the seal should be more resistant to cracking caused by thermal expansion mismatches. Further, seals including the C/SiC material exhibit superior resistance to cold, having been emerged in liquid nitrogen without showing any evidence of cracking.

While there have been shown and described what are at present considered to be the preferred embodiments of the invention, it will be apparent to those skilled in the art that various changes and modifications can be made herein without departing from the scope of the invention as defined by the appended claims.

What is claimed is:

1. A lamp, comprising:

a high-temperature glass envelope, at least one feedthrough assembly, and a light source disposed within the envelope;

the at least one feedthrough assembly having an inner electrical lead connected to the light source, an outer electrical lead for conducting electrical energy from an outside source to the light source, and an intermediate connector electrically connecting the inner and outer electrical leads, the intermediate connector comprising a uni-directional carbon fiber mat infiltrated with SiC and being resistant to oxidation within a temperature range up to 1200° C. and having a thermal expansion coefficient in the range of 0-2 ppm/° C.; and the intermediate connector being sealed within a seal area of the envelope.

2. The lamp of claim 1 wherein the high-temperature glass is fused quartz or fused silica.

3. The lamp of claim 1 wherein the light source is a tungsten filament.

4. The lamp of claim 1 wherein the light source is an arc discharge.

5. The lamp of claim 1 wherein the light source is further contained within an inner envelope.

6. The lamp of claim 1 wherein the envelope is disposed within an outer jacket.

7. A feedthrough assembly for sealing in a high-temperature glass, the assembly comprising an inner electrical lead, an outer electrical lead and an intermediate connector that electrically connects the inner and outer electrical leads, the intermediate connector comprising a uni-directional carbon fiber mat infiltrated with SiC and being resistant to oxidation within a temperature range up to 1200° C. and having a thermal expansion coefficient in the range of 0-2 ppm/° C.

* * * * *